United States Patent [19]

Vogt et al.

[11] 4,031,022

[45] June 21, 1977

[54] BUILDERS FOR DETERGENT AND CLEANING COMPOSITIONS

[75] Inventors: Wilhelm Vogt, Hurth-Efferen; Eberhard Auer, Erftstadt Liblar; Günter Lenz, Frachen-Bachem; Karl Merkenich, Hurth-Efferen; Klaus Henning, Hurth-Hermulheim; Joachim Kandler, Erftstadt Lechenich, all of Germany

[73] Assignee: Hoechst Aktiengesellschaft, Frankfurt am Main, Germany

[22] Filed: Mar. 2, 1976

[21] Appl. No.: 663,053

Related U.S. Application Data

[62] Division of Ser. No. 472,298, May 22, 1974, abandoned.

[30] Foreign Application Priority Data

May 28, 1973 Germany ..... 2327141

[52] U.S. Cl. ..... 252/89 R; 252/135; 252/526; 252/527; 252/531; 252/539; 252/545; 252/546; 252/550; 252/558

[51] Int. Cl.[2] ..... C11D 3/20; C11D 7/26

[58] Field of Search ..... 252/DIG. 2, DIG. 11, 252/89, 132, 135, 539, 558; 260/78.3 UA, 80.3

[56] References Cited

UNITED STATES PATENTS

| | | | |
|---|---|---|---|
| 3,627,686 | 12/1971 | Sabatelli et al. | 252/527 |
| 3,706,672 | 12/1972 | Martin | 252/156 |
| 3,839,215 | 10/1974 | Mulders | 252/181 |
| 3,890,291 | 6/1975 | Vogt et al. | 260/80.3 R |
| 3,904,685 | 9/1975 | Shahidi et al. | 260/537 N |
| 3,922,230 | 11/1975 | Lamberti et al. | 252/89 |
| 3,950,260 | 4/1976 | Eldib | 252/89 |

OTHER PUBLICATIONS

Chem. Absts., Bernd et al., "Sodium Poly(α–hydroxyacrylate)–Containing Detergents".

*Primary Examiner*—P.E. Willis, Jr.
*Attorney, Agent, or Firm*—Connolly and Hutz

[57] ABSTRACT

Builders for detergent and cleaning compositions. The builders comprise copolymers made from α-hydroxyacrylic acid and acrylic acid. The copolymers contain between 9 and 85 mol % of acrylic acid and have a relative viscosity within the range 0.05 and 1.0, determined on a 1 weight % solution of the copolymers in aqueous 2N-sodium hydroxide solution, at 20° C.

5 Claims, 1 Drawing Figure

Figure 1:
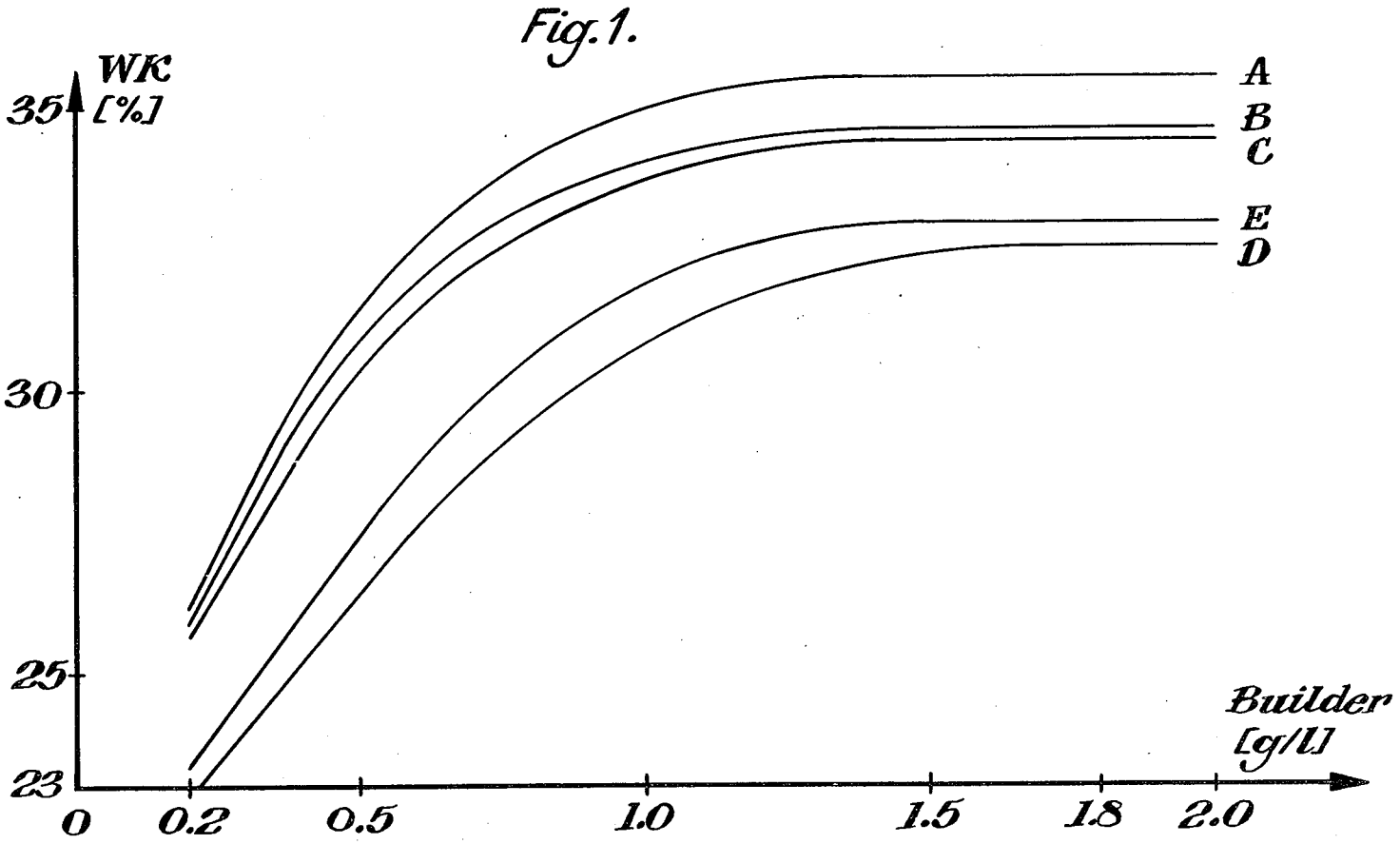

A
B
C
E
D
Wk [%]
35
30
25
23
0
0.2
0.5
1.0
1.5
1.8
2.0
Builder [g/l]

BUILDERS FOR DETERGENT AND CLEANING COMPOSITIONS

This application is a division of application Ser. No. 472,298 filed May 22, 1974, now abandoned.

The present invention provides builders for detergents and cleaning agents, the builders comprising copolymers of α-hydroxyacrylic acid and acrylic acid, and the water-soluble salts thereof.

It has already been reported that the cleaning power of soaps and synthetic detergents in detergent and cleaning agents can be improved by means of certain water softeners. These cleaning intensifiers are termed builders. Detergent and cleaning agents having such builders therein are more effective, yet less costly than corresponding formulations which are free from builders.

In addition to a non-ionic surfactant, which merely enables hydrophobic dirt, such as carbon black and fat particles, to be dispersed and/or peptized, it is necessary for a detergent to contain a further ingredient removing hydrophilic dirt, namely a builder. In the absence of a builder, incrusted dirt on the fabric is but incompletely taken up by the cleaning bath during washing and dirt particles are found to deposit on the fabrics. As a result, it is impossible to produce satisfactory cleaning effects.

The mechanism and the details of the "builder effect" have not yet been fully described. Vital to the function of the builders is a plurality of processes comprising, for example: the stabilization of pigment dirt suspensions; the emulsification of dirt particles; the effect on the surface and interfacial properties of aqueous surfactant solutions; the solubilization of water-insoluble ingredients of the cleaning bath; the peptization of agglomerated dirt; the neutralization of acid substances; and the inactivation of mineral matter in the cleaning bath.

To determine the quality and qualification of individual materials for use as a builder, it is good practice to test their power for sequestering Ca-ions, their power for forming stable dispersions as well as their behaviour and efficiency in washing or cleaning operations, to ensure the qualitative and quantitative determination of all factors that make their contribution to the builder effect.

Customary builders comprise water-soluble alkali metal salts of mineral acids, such as alkali metal carbonates, borates, phosphates, polyphosphates, bicarbonates, and silicates.

While a plurality of materials have been suggested for use as builders, the fact remains that linear condensed alkali metal phosphates, more particularly sodium tripolyphosphate, are almost exclusively used as the builders in customary detergent and cleaning agents having up to substantially 50 weight percent of builders therein.

The considerably increased consumption of phosphate-containing detergent and cleaning agents both for domestic and industrial purposes has also effected an increase in the phosphate content of natural waters. In studies of the eutrophication of waters, which has been found to occur at increasing rates, the water-soluble nitrate and phosphate salts have recently been held to have properties that are able under certain conditions to promote the growth of certain alga species, and thereby to make their contribution to the eutrophication of water. Even though it is impossible for the time being definitely to clarify this problem, namely the contribution of phosphate-containing detergents and cleaning agents to the eutrophication of water, it is highly desirable to have potential substitutes free from nitrogen and phosphorus for the builders that find widespread use in current detergent formulations.

Compounds which are free from nitrogen and phosphorus have already been suggested for use as builders in detergents. Starch derivatives, such as dicarboxyl and carboxymethyl starch, or polymeric carboxylic acids, such as polymaleic acid and polyitaconic acid as well as their copolymers with unsaturated carboxylic acids, olefins or short-chain unsaturated aliphatic ethers or alcohols, have been used heretofore. Further customary builders comprise oxydiacetic acid, oxydisuccinic acid, cyclocarboxylic acids, such as benzene penta- or tetra-carboxylic acid, esters of polyethyleneglycol and adipic acid or maleic acid containing sulfonate groups, as well as esters of ethylene glycol and tri- or tetracarboxylic acids. In German published specifications "Offenlegungsschriften" 2,136,672, and 2,161,727 and in an article published by P. Berth, G. Jakobi and E. Schmadel in Chemiker-Zeitung 95 (1971), pages 548–553, it has finally been suggested that poly-α-hydoxyacrylic acid or polyacrylic acid or their alkali metal salts should be used as builders in detergent and cleaning agents.

The above builder substances are however not fully satisfactory; they have more particularly been found to merely posses unsatisfactory builder properties, such as those reported above, and accordingly to produce unsatisfactory cleaning effects. Still further, the art is partially in need of processes which would permit these customary builders to be made under commercially attractive conditions. The present invention now provides builders which are free from the disadvantageous effects referred to hereinabove.

In accordance with the present invention, we have now found that an α-hydroxyacrylic acid/acrylic acid-copolymer, or the sodium salt thereof, unexpectedly has a sequestering power for polyvalent metal ions considerably exceeding that of poly-α-hydroxyacrylic acid or polyacrylic acid or of their alkali metal or ammonium salts.

The present invention relates more particularly to builders for detergent and cleaning agents, the builders comprising α-hydroxyacrylic acid/acrylic acid-copolymers containing between about 9 and 85 mol % of acrylic acid and having a relative viscosity substantially within the range 0.05 and 1.0, determined on a 1 weight % solution of the copolymers in aqueous 2N-sodium hydroxide solution, at 20° C.

The copolymer of the present invention has a capacity for suspending lime exceeding its stoichiometric capacity significantly. In other words, the copolymer produces an unexpected effect of synergism. It adds to the unobviousness of the present result that the capacity for suspending lime of polyacrylic acid has been reported by P. Berth, G. Jakobi and E. Schmadel in Chemiker Zeitung 95 (1971), pages 548–553, to correspond fairly accurately to the stoichiometric ratio. By partially replacing poly-α-hydroxyacrylic acid by inexpensive acrylic acid, it is possible for the copolymer production costs to be reduced considerably which is very advantageous for the commercial use of the copolymer as a builder in detergent and cleaning agents.

In accordance with a preferred feature of the present invention, the builders are comprised of copolymers which contain between 16 and 50 mol % of acrylic acid and have a relative viscosity substantially within the range 0.1 and 0.8, determined on a 1 weight % solution of the copolymers in aqueous 2N-sodium hydroxide solution, at 20° C.

It has been found very advantageous to use the water-soluble salts, e.g. the alkali metal or ammonium salts of the α-hydroxyacrylic acid/acrylic acid copolymers, as one of the ingredients of detergent and cleaning agents, in a proportion substantially within the range 10 and 90 weight %, preferably within the range 20 and 60 weight %, based on the detergent and cleaning agents.

The invention also provides detergent and cleaning agents, which are based on anion-active, cationic, amphoteric, ampholytic and/or non-ionic surfactants in admixture with further addends, if desired, the detergent and cleaning agents containing α-hydroxyacrylic acid/acrylic acid copolymers, which contain substantially between 9 and 85 mol % of acrylic acid and have a relative viscosity substantially within the range 0.05 and 1, determined on 1 weight % solutions of the copolymers in aqueous 2N-sodium hydroxide solution, at 20° C.

The copolymers should more preferably contain between 16 and 50 mol % of acrylic acid and should have a relative viscosity substantially within the range 0.1 and 0.8, determined on 1 weight % solutions of the copolymers in aqueous 2N-sodium hydroxide solution at 20° C.

In accordance with the present invention, the detergent and cleaning agents should preferably contain the water-soluble salts, e.g. the alkali metal or ammonium salts of the copolymers, in a proportion substantially within the range 10 and 90 weight %, more preferably within the range about 20 and 60 weight %.

In addition to the builders of the present invention, the detergent and cleaning agents may contain one or more customary builders, e.g. alkali metal polyphosphates. The surfactants preferably used in the detergents include anionic or non-ionic substances.

The anionic surfactants include more particularly the water-soluble salts of higher fatty acids or resinic acids, such as sodium or potassium soaps of hardened or nonhardened coco palm-kernel oil or beet oil, or of tallow and the mixtures thereof. The anion-active substances used in accordance with this invention also include higher alkylsubstituted, mononuclear and aromatic sulfonates, e.g. alkylbenzenesulfonates containing between 9 and 14 carbon atoms in the alkyl radical, alkyltoluenesulfonates, alkylxylenesulfonates, alkylphenolsulfonates or alkylnaphthalenesulfonates and sulfatized aliphatic alcohols or alcohol ethers, such as sodium or potassium lauryl or hexadecylsulfate, triethanolaminelaurylsulfate, sodium or potassiumoleylsulfate, and sodium or potassium salts of laurylsulfate ethoxylated with substantially between 2 and 6 mols of ethylene oxide, and similar materials.

The non-ionic surfactants normally used in detergent and cleaning agents are compounds which have an organic hydrophobic group and a hydrophilic radical. Exemplary representatives of these non-ionic surfactants are the condensation products of alkylphenols with ethylene oxide or of higher fatty alcohols with ethylene oxide, the condensation products of polypropyleneglycol with ethylene oxide or propylene oxide, and the condensation products of ethylene oxide with the reaction product of ethylenediamine and propylene oxide. The above compounds also include long-chain tertiary amine oxides.

The surfactants used in the detergent and cleaning agents of the present invention finally include ampholytic and amphoteric materials, for example derivatives of aliphatic secondary and tertiary amines or quaternary ammonium compounds having from 8 to 18 carbon atoms and a hydrophilic group in the aliphatic radical, e.g. sodium-3-dodecylaminopropionate; sodium-3-dodecylaminopropane-sulfonate; 3-(N,N-dimethyl-N-hexadecylamino)-propane-1-sulfonate or fatty acid amidoalkyl-N,N-dimethylacetobetain, the fatty acid containing between 8 and 18 carbon atoms and the alkyl radical containing 3 carbon atoms.

Further addends, which may be used in the detergent and cleaning agents of the present invention, include, for example: the alkali metal or ammonium salts of sulfuric acid, silicic acid, carbonic acid, boric acid, alkylene-, hydroxyalkylene- or aminoalkylene- phosphonic acid. The addends also include bleaching agents, stabilizers for peroxide compounds, and water-soluble organic complex formers.

These latter groups of compounds comprise more particularly sodium perborate monohydrate or tetrahydrate, alkali metal salts of peroxymono- or disulfuric acid, peroxohydrates of ortho-, pyro- and polyphosphates, water-insoluble precipitated magnesium silicate, and alkali metal salts of iminodiacetic acid, nitrilotriacetic acid and ethylenediaminetetracetic acid.

Still further useful ingredients of the detergent and cleaning compositions are substances improving the capacity of washing liquors for suspending or peptizing dirt, such as carboxymethylcellulose, polyvinyl alcohol, polyvinylpyrolidone, or foam regulators, such as mono- and dialkylphosphoric acid esters containing between 16 and 20 carbon atoms in the alkyl radical, as well as optical brighteners, disinfectants and/or proteolytic enzymes.

The builders of the present invention or the detergent and cleaning compositions made therewith offer technically beneficial properties as they considerably delay or prevent the precipitation of calcium ions in the washing bath and still further produce stable dispersions both with hydrophilic and hydrophobic dirt particles. A further advantage resides in the fact that the builders of the present invention are free from phosphorus or nitrogen and accordingly fail to contribute to the eutrophication of natural waters.

The copolymers, which are used in the detergent and cleaning compositions of the present invention, have a capacity for suspending lime which is unexpectedly more than twice as high as the stoichiometric capacity, whereas polyacrylic acid or its sodium salt has a capacity for suspending lime determined stoichiometrically substantially identical with the actual value. Poly-α-hydroxyacrylic acid actually compares slightly more favorable with, yet differs substantially from, the copolymer builders of the present invention.

The following Examples illustrate the invention. Examples 1 to 6 describe the preparation of the builders of the present invention whereas Examples 7 and 8 describe their capacity for suspending lime and efficiency during washing in the presence of further detergent components.

EXAMPLE 1

A blend of 213 g (2 mols) of α-chloracrylic acid and 1.5 l of benzene was placed in a polymerization vessel, heated therein to 80° C and the heated blend was mixed with 1 g of benzoyl peroxide. Following this, 72 g (1 mol) of acrylic acid was introduced dropwise, within 30 min. and with thorough agitation, into the blend. A further 2 g of benzoyl peroxide was added, the blend was allowed to remain at 80° C over a period of 5 hours, then cooled, and the polymer was filtered off and dried. 286 g of a copolymer containing 24.1 % of chlorine was obtained. The copolymer contained 34 mol % of acrylic acid having regard to the fact that traces of HCl gas were set free during the polymerization. The polymer had a relative viscosity of 0.63, determined on a 1 weight % solution of the polymer in dimethyl formamide, at 25° C.

The α-hydroxyacrylic acid/acrylic acid copolymer was made by stirring 80 g of the above chlorine-containing copolymer into 800 cc of water and heating it to boiling for 3 hours with thorough agitation. The resulting finely pulverulent hydrolyzate was filtered off and dried. It was obtained in a yield of 55 g.

The polymer had a relative viscosity of 0.34, determined on a 1 weight % solution of the polymer in aqueous 2N-NaOH, at 20° C.

EXAMPLE 2

A blend of 213 g (2 mols) of α-chloracrylic acid, 14.4 g (0.2 mol) of acrylic acid and 2 l of Essovarsol $^R$ (this is a mineral oil fraction boiling within the limits of 144° and 175° C, marketed by Esso) was placed in a polymerization vessel, heated to 80° C therein and mixed with 2.13 g of benzoyl peroxide. The blend was stirred for 5 hours at 80° C, allowed to cool and the resulting polymer was filtered off. The polymer was washed with a low-boiling petroleum ether and dried. 222 g of a polymer containing 28.6 % of chlorine and 9 mol % of acrylic acid was obtained.

140 g of the polymer so made was stirred into 1.5 l of boiling water and made into an α-hydroxyacrylic acid-containing polymer, as described in Example 1. The polymer was obtained in a yield of 86 g. It had a relative viscosity of 0.15, determined on a 1 weight % solution of the polymer in 2N-NaOH, at 20° C.

EXAMPLES 3 – 5

The procedure was the same as that described in Example 2 save that different proportions of acrylic acid and initiator were used. The results obtained are indicated in the following Table:

TABLE 1

| Example | 3 | 4 | 5 |
|---|---|---|---|
| A | 28.8 | 72.0 | 144.0 |
| B | 2.13 | 3.0 | 3.6 |
| C | 236.0 | 280.0 | 353.0 |
| D | 26.7 | 22.5 | 18.3 |
| E | 17.0 | 34.0 | 50.0 |
| F | 0.57 | 0.48 | 0.52 |
| G | 89.0 | 97.0 | 104.0 |
| H | 0.20 | 0.30 | 0.36 |

In the above Table, the letter symbols have the following meanings:

A = Quantity of arcylic acid used, in g
B = Quantity of benzoyl peroxide used, in g
C = Yield of chlorine-containing copolymer, in g
D = Chlorine content of copolymer, in %
E = Acrylic acid fraction in chlorine-containing copolymer, in mol %
F = Relative viscosity of polymer, determined on a 1 weight % solution of the polymer in dimethyl formamide, at 25° C
G = Yield of hydrolyzed copolymer, in g
H = Relative viscosity of hydrolyzed polymer, determined on a 1 weight % solution of the polymer in aqueous 2N-NaOH, at 20° C.

EXAMPLE 6

213 g (2 mols) of α-chloracrylic acid was dissolved in a polymerization vessel in 7.5 l of Essovarsol and the solution was heated to 80° C. Following the addition of 3.5 g of benzoyl peroxide, 720 g (10 mols) of acrylic acid was added dropwise within 3 hours with thorough agitation. In addition to this altogether four 1.5 g portions of benzoyl peroxide were added at intervals of 1 hour. After a reaction period of 8 hours, the polymer was filtered off, washed with a low-boiling petroleum ether and dried.

938 g of a polymer containing 7.5 % of chlorine and 85 mol % of acrylic acid was obtained.

The copolymer had a viscosity of 0.79, determined on a 1 weight % solution of the copolymer in dimethyl formamide, at 25° C.

80 g of the copolymer was hydrolyzed by boiling it for 3 hours in 1 l of water and the solution was successively evaporated to dryness.

The hydrolyzate was obtained in a yield of 69 g. The polymer had a viscosity of 0.55, determined on a 1 weight % solution of the polymer in 2N-aqueous NaOH, at 20° C.

EXAMPLE 7

The hydrolyzed products prepared in the manner described in Examples 1 to 6 were tested as to their capacity for suspending lime (CSL). To this end, an aqueous sodium carbonate-containing solution, which contained 0.2 weight % of the hydrolyzed product and had a pH of 10, was titrated with an aqueous 0.05 N-calcium acetate solution until it remained turbid. The value determined for the lime suspending capacity indicates the number of milligrams of calcium ions kept in solution by 1 g of the hydrolyzed product.

The stoichiometric capacity for suspending lime of the hydrolyzed products can be calculated along the following formula:

$$CSL = \frac{\text{atomic weight Ca}}{2 \times E} \cdot 1000 = \frac{20\,000}{E} \left[\frac{\text{mg}}{\text{g}}\right]$$

wherein E stands for the equivalent weight of the hydrolyzed product, determined by acidimetric titration.

In the following Table 2, the values determined for the capacity for suspending lime of the products of this invention are compared with the values determined for polyacrylic acid and poly-α-hydroxyacrylic acid, respectively.

TABLE 2

| Product | E | Capacity for suspending lime | |
|---|---|---|---|
| | | theoretical | effective |
| Example 1 | 81.4 | 246 | 310 |
| Example 2 | 82.9 | 241 | 409 |
| Example 3 | 82.8 | 242 | 425 |
| Example 4 | 81.5 | 245 | 464 |
| Example 5 | 84.5 | 237 | 684 |
| Example 6 | 74.7 | 268 | 507 |

TABLE 2-continued

| Product | E | Capacity for suspending lime theoretical | effective |
|---|---|---|---|
| Polyacrylic acid | 72.3 | 277 | 274 |
| Poly-αhydroxy-acrylic acid | 82.5 | 242 | 265 |

As results from Table 2, the products of the invention distinguish very favorably in their capacity for suspending lime over the comparative products. More particularly, the present products enable substantially more $Ca^{++}$-ions to be kept in solution.

The poly-α-hydroxyacrylic acid used as a comparative product in Table 2 was prepared in the following manner:

a. A blend of 100 g of α-chloracrylic acid, 400 cc of benzene and 1 g of benzoyl peroxide was placed in a round flask provided with stirrer and reflux condenser, and heated to boiling therein for 3 hours under nitrogen. The precipitated polymer was separated and dried at 40° C under vacuum. Poly-α-chloracrylic acid was obtained in a yield of 100 %, based on the theoretical.

b. An aqueous solution of poly-α-chloracrylic acid saturated at 30° C was prepared and heated to boiling for 2 hours. Precipitating hydrolyzate was washed until free from chloride and dried at 60° C under vacuum. Poly-α-hydroxyacrylic acid was obtained in a yield of 77 g or 100 % of the theoretical. The hydrolyzate had a molecular weight of 2800 and a sequestering power for lime of 265 mg of Ca/g.

c. The sodium salt was produced by neutralizing 25 g of poly-α-hydroxyacrylic acid with 25 g of 50 % NaOH and evaporation of the water.

EXAMPLE 8

Wash tests were made to determine the cleaning power of wash liquors which for a constant concentration of known detergent components contained varying proportions of the A, B and C builders of the present invention and the test results obtained were graphically plotted in FIG. 1 of the accompanying graphs. The A, B and C builders were the sodium salts of the hydrolyzed products prepared in Examples 1, 3 and 6. Analogous wash tests with the use of conventional D and E builders were made for the purpose of comparison, and the cleaning power was also graphically plotted in FIG. 1, in the form of curves. Builder D was the sodium salt of a polyacrylic acid, of which an aqueous 40 weight % solution had a viscosity of 1900 centipoises, at 25° C, and builder E was the sodium salt of poly-α-hydroxyacrylic acid, which was prepared as hereinbefore described.

The wash tests were made on standard cotton fabrics soiled with "Krefeld" dirt in a "Launder-O-meter" at a wash bath temperature of 95° C. Standard fabrics soiled with Krefeld dirt have been defined by Kurt Lindner in the book entitled; "Tenside, Textilhilfsmittel — Waschrohstoffe", Wissenschaftl. Verlagsgesellschaft Stuttgart (1964), volume II, page 1837.

The wash water had a hardness of 20° (German degrees of hardness) and a pH of 10. The wash period was 30 minutes and the bath ratio, expressed by the ratio of material to be washed in kg to wash liquour in liter was 1:50, and the wash operation was carried out in the presence of 10 steel balls.

After the prescribed wash time, the standard cotton fabric was rinsed, once hot and once cold, with water of identical hardness, and its degree of whiteness was then determined using an Elrepho remission photometer, (a product of Zeiss) and a filter R 53. Based on the test result obtained, the cleaning power was calculated according to the following formula:

$$\% WK = \% WG_g - \% WG_b$$

in which

% WK = % cleaning power,

% $WG_g$ = % whiteness of washed fabric

% $WG_b$ = % whiteness of unwashed fabric.

The above wash tests were made with the use of a wash liquor which contained, per 1000 milliliters of water:

0.45 gram/liter of dodecylbenzenesulfonate,
0.15 gram/liter of tallow fatty alcohol ethoxylated with 11 mols of ethylene oxide per mol of alcohol,
0.15 gram/liter of hardened tallow soap,
0.15 gram/liter of magnesium silicate,
0.15 gram/liter of sodium silicate,
1.25 grams/liter of sodium perborate tetrahydrate,
0.45 gram/liter of sodium sulfate,
0.05 gram/liter of tylose, and
0.2 – 2 grams/liter of builder A or B or C or D or E Curves A through E in the accompanying graphs demonstrate the cleaning power inherent to the individual wash liquors. Curves A, B and C represent the results obtained in wash tests made with the use of the A, B and C builders of the present invention, whereas curves D and E represent the results obtained in wash tests made with the use of known D and E builders. A wash liquor containing 1.8 gram/liter of builders A, B and C, respectively: was found to have a cleaning power of 35.5 %, 34.6 % and 34.4 %, respectively. The same liquor, save that it contained builders D and E, respectively, had a cleaning power of merely 32.6 and 33.0, respectively. As can be seen, the builders of the present invention were found also to compare favorably with the known builders, in the standard wash test.

We claim:

1. Detergent and cleaning compositions in which the principal cleaning components are an anion-active, cationic, amphoteric, ampholytic or non-ionic surfactant and an organic builder consisting of a copolymer of alpha-hydroxyacrylic acid and acrylic acid, said copolymer having a specific viscosity within the range 0.05 and 1.0 determined on 1 weight % solution of the copolymer in aqueous 2N-sodium hydroxide solution at 20° C, and containing between about 9 and 85 mol % of acrylic acid and the said copolymer being present in the compositions in a proportion within the range 10 and 90 weight %.

2. The detergent and cleaning compositions as claimed in claim 1, wherein the builder is in a proportion within the range 20 and 60 weight %.

3. The detergent and cleaning compositions as claimed in claim 1, wherein the copolymer contains between 16 and 50 mol % of acrylic acid and has a relative viscosity within the range 0.1 and 0.8, determined on 1 weight % solution of the copolymer in aqueous 2N-sodium hydroxide solution, at 20° C.

4. The detergent and cleaning compositions as claimed in claim 1, wherein the builder is the water-soluble salt of the copolymer.

5. The detergent and cleaning compositions as claimed in claim 4, wherein the builder is the alkali metal or ammonium salt of the copolymer.

* * * * *